US011852368B2

(12) United States Patent
Han

(10) Patent No.: US 11,852,368 B2
(45) Date of Patent: Dec. 26, 2023

(54) AIR CONDITIONER ELECTRIC CONTROL ASSEMBLY AND AIR CONDITIONER

(71) Applicant: GD MIDEA AIR-CONDITIONING EQUIPMENT CO., LTD., Foshan (CN)

(72) Inventor: Yuezheng Han, Foshan (CN)

(73) Assignee: GD MIDEA AIR-CONDITIONING EQUIPMENT CO., LTD., Foshan (CN)

( * ) Notice: Subject to any disclaimer, the term of this patent is extended or adjusted under 35 U.S.C. 154(b) by 550 days.

(21) Appl. No.: 17/058,241

(22) PCT Filed: Jun. 26, 2018

(86) PCT No.: PCT/CN2018/092896
§ 371 (c)(1),
(2) Date: Nov. 24, 2020

(87) PCT Pub. No.: WO2019/227554
PCT Pub. Date: Dec. 5, 2019

(65) Prior Publication Data

US 2021/0156588 A1 May 27, 2021

(30) Foreign Application Priority Data

May 28, 2018 (CN) ..... 201810527362.4

(51) Int. Cl.
*F25B 49/00* (2006.01)
*F24F 11/88* (2018.01)

(52) U.S. Cl.
CPC ..... *F24F 11/88* (2018.01)

(58) Field of Classification Search
CPC ..... F24F 11/88
(Continued)

(56) References Cited

U.S. PATENT DOCUMENTS

2016/0278212 A1 9/2016 Takayuki et al.

FOREIGN PATENT DOCUMENTS

CN 2511909 Y 9/2002
CN 2512161 Y 9/2002
(Continued)

OTHER PUBLICATIONS

World Intellectual Property Organization (WIPO) International Search Report and Written Opinion for PCT/CN2018/092896 with translation dated Jan. 24, 2019 12 Pages.
(Continued)

*Primary Examiner* — Davis D Hwu
(74) *Attorney, Agent, or Firm* — ANOVA LAW GROUP PLLC

(57) ABSTRACT

An air conditioner electric control assembly includes an electric control board including an alternating-current power supply input interface configured to receive an external alternating-current power supply, a first power supply interface connected to the alternating-current power supply input interface and configured to output a high-voltage alternating current, a second power supply interface configured to connect a low-voltage alternating-current power supply or a low-voltage direct-current power supply, a rectifier circuit mounting site connected to the second power supply interface, a filter circuit mounting site connected to the rectifier circuit mounting site, a drive circuit connected to the filter circuit mounting site, a switch device connected to the drive circuit, and a microcontroller unit (MCU) connected to the drive circuit and configured to control the drive circuit to drive the switch device to switch state to drive a load to operate.

19 Claims, 4 Drawing Sheets

(58) Field of Classification Search
USPC ..... 62/132
See application file for complete search history.

(56) References Cited

FOREIGN PATENT DOCUMENTS

| | | | | |
|---|---|---|---|---|
| CN | 1975275 | A | | 6/2007 |
| CN | 201097176 | Y | | 8/2008 |
| CN | 101270907 | A | | 9/2008 |
| CN | 203800326 | U | | 8/2014 |
| CN | 204063310 | U | | 12/2014 |
| CN | 204633456 | U | | 9/2015 |
| CN | 204830335 | U | | 12/2015 |
| CN | 105299835 | A | | 2/2016 |
| CN | 207251482 | U | | 4/2018 |
| EP | 2163833 | A2 | | 3/2010 |
| JP | 2002101550 | A | * | 4/2002 |
| JP | 2018078756 | A | | 5/2018 |
| WO | 2015018275 | A1 | | 2/2015 |
| WO | 2016209017 | A1 | | 12/2016 |

OTHER PUBLICATIONS

The State Intellectual Property Office of PRC (SIPO) the First Office Action for CN Application No. 201810527362.4, dated Jul. 24, 2019 15 Pages (Translation Included ).
The State Intellectual Property Office of PRC (SIPO) the Second Office Action for CN Application No. 201810527362.4, dated Mar. 16, 2020 12 Pages (Translation Included ).
The European Patent Office (EPO) Extended Search Report for EP Application No. 18920383.9 dated Jul. 13, 2021 12 Pages.

* cited by examiner

AIR CONDITIONER ELECTRIC CONTROL ASSEMBLY AND AIR CONDITIONER

CROSS-REFERENCE TO RELATED APPLICATIONS

This application is a National Stage Entry under 35 U.S.C. § 371 of International Application No. PCT/CN2018/092896, filed Jun. 26, 2018, which claims priority to Chinese Application No. 201810527362.4, filed May 28, 2018, the entire contents of both of which are incorporated herein by reference.

TECHNICAL FIELD

The invention relates to the field of electric control board design, in particular to an air conditioner electric control assembly and an air conditioner.

BACKGROUND

At present, the electric control board of the home appliance controller will be applied with many types of power supply solutions, such as the linear transformer stabilized power supply solution and the switch power supply solution. Because these two power solutions have different costs and different standby power consumptions, switch power solution needs to be applied to the low-power standby mode, while for low-cost applications, the linear transformer-regulated power supply solution is used. For the same appliance controller, in order to cope with different market environments, the above-mentioned power supply solutions will need to be adopted. At this time, the electric control board needs to be redesigned. If there are many models of the same household appliance and the above-mentioned different solutions are required, the workload of the electric control board design will be doubled, and more types of electric control boards will be involved, which is not convenient for the production management of electric control boards.

The foregoing content is only used to assist in understanding the technical solution of the present invention, and does not mean that the foregoing content is recognized as prior art.

SUMMARY

The main purpose of the invention is to provide an air conditioner electric control assembly, aiming at solving the problems that when an existing electric control board adopts different power supply schemes, troubles of design of the electric control board are caused and more types of the electric control board are involved, which is not convenient for production management.

To realize the purpose above, the present invention provides an air conditioner electric control assembly including an electric control board, which further includes an MCU, a drive circuit, a switch device, a rectifier circuit mounting site, a filter circuit mounting site, a first power supply interface, a second power supply interface, and a first alternating-current power supply input interface.

The electric control board is configured to receive an external alternating-current power supply from the first alternating-current power supply input interface.

The first power supply interface is connected to the first alternating-current power supply input interface to output high-voltage alternating current. The second power supply interface is connected to the rectifier circuit mounting site, the rectifier circuit mounting site is connected to the filter circuit mounting site, the filter circuit mounting site is connected to the drive circuit, and the second power supply interface is configured to connect a low-voltage alternating-current power supply or a low-voltage direct-current power supply.

The MCU is configured to control the drive circuit to drive the switch device to switch a switch state to drive a load to operate.

Preferably, the first power supply interface is a plug or a socket configured for plug-in connection, and/or, the second power supply interface is a plug or a socket configured for plug-in connection.

Preferably, the first power supply interface is configured on the electric control board or connected to the electric control board through a connection wire.

The second power supply interface is configured on the electric control board or connected to the electric control board through a connection wire.

Preferably, the air conditioner electric control assembly further includes a switch power supply board discretely configured relative to the electric control board.

The switch power supply board includes a direct-current power supply output interface connected to the second power supply interface, and a second alternating-current power supply input interface connected to the first power supply interface.

Two conductive wires are installed on the rectifier circuit mounting site of the electric control board to short connect inputs and outputs of the rectifying circuit.

Preferably, the direct-current power supply output interface is a plug or a socket for plug-in connection, the second alternating-current power supply input interface is a plug or a socket for plug-in connection.

Preferably, the air conditioner electric control assembly further includes a linear transformer, the linear transformer includes a third alternating-current power supply input interface connected to the first power supply interface, and a low-voltage alternating-current power supply output interface connected to the second power supply interface; a rectifying circuit device is installed on the rectifier circuit mounting site to form a rectifying circuit, and a filter device is installed on the filter circuit mounting site to form a filter circuit.

Preferably, a mounting area is configured on the electric control board, the linear transformer is installed on the mounting area, or the second power supply interface and the first power supply interface are installed on the mounting area.

Preferably, the linear transformer is discretely configured relative to the electric control board.

The third alternating-current power supply input interface is a plug or a socket configured for plug-in connection, and the low-voltage alternating-current power supply output interface is a plug or a socket configured for plug-in connection.

The third alternating-current power supply input interface and the low-voltage alternating-current power supply output interface are connected to the linear transformer through connection wires.

To realize the purpose above, the present invention further provides an air conditioner including the air conditioner electric control assembly.

The electric control assembly provided by the present invention includes an MCU, a drive circuit, a switch device, a rectifier circuit mounting site, a filter circuit mounting site, a first power supply interface, a second power supply interface and a first alternating-current power supply input interface, and is connected to a switch power supply board or a linear transformer through the second power supply interface and the first alternating-current power supply input interface, so as to adopt power supply modules of different power supply schemes. Therefore, for different power supply schemes, the electric control board can be generalized without redesign, which simplifies the design of the electric control board, reduces the cost, and facilitates the management of production of air conditioner electric control assemblies.

DETAILED DESCRIPTION OF THE EMBODIMENTS

Embodiments of the present invention are described in detail below, examples of which are illustrated in the accompanying drawings. Same or similar characters denote same or similar devices or devices with a same or similar functionality. The embodiments described below with reference to the drawings are exemplary and are intended to be used to explain the invention and are not to be construed as limiting the invention.

The invention provides an electric control board, which can be used as a household appliance controller, such as for an air conditioner, a refrigerator, a washing machine and the like.

Figure 1:
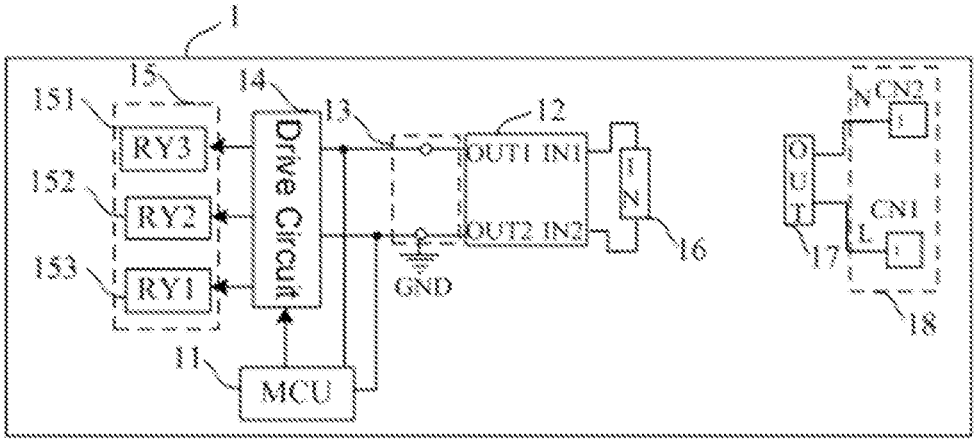
FIG. 1 is a schematic module diagram of an electric control board of a first embodiment of an air conditioner electric control assembly according to the present invention.

Referring to FIG. 1, which is a schematic module diagram of an electric control board according to a first embodiment of the present invention. In order to facilitate description, only a part related to embodiments of the present invention is shown, and detailed descriptions are provided below.

An air conditioner electric control assembly includes an electric control board 1. The electric control board 1 includes an MCU 11, a drive circuit 14, a switch device 15, a rectifier circuit mounting site 12, a filter circuit mounting site 13, a first power supply interface 17, a second power supply interface 16 and a first alternating-current power supply input interface 18.

External alternating-current power supply is received by the electric control board 1 through the first alternating-current power supply input interface 18.

The MCU 11 drives the switch device 15 to change a state of a switch to drive a load to operate through the drive circuit 14. In FIG. 1, the switch device 15 specifically includes relays 151, 152 and 153. For the air conditioner, the load includes a compressor, an inner fan, an external fan, a four-way valve and the like.

The first power supply interface 17 is connected to the first alternating-current power supply input interface 18 to output a high-voltage alternating current. The second power supply interface 16 is connected to the rectifier circuit mounting site 12. The rectifier circuit mounting site 12 is connected to the filter circuit mounting site 13. The filter circuit mounting site 13 is connected to the drive circuit 14, and the second power supply interface 16 is configured for connecting a low-voltage alternating-current power supply or a low-voltage direct-current power supply.

The rectifier circuit mounting site 12 is configured to have two inputs IN1, IN2 and two outputs OUT1, OUT2. A device can be installed on the rectifier circuit mounting site 12 to form a rectifying circuit or the rectifier circuit mounting site 12 remains blank. When the rectifying circuit is formed, the two inputs IN1, IN2 input the low-voltage alternating-current power, and a pulsating direct current is output from the two outputs OUT1, OUT2. A device can be installed on the filter circuit mounting site 13 to form a filtering circuit or to the filter circuit mounting site 13 remains blank, and the specific mounting scheme is dependent on a power supply module scheme by which the first alternating-current power supply input interface 18 is connected to the first power supply interface 17.

The first power supply interface 17 is a plug or a socket configured for plug-in connection, and/or the second power supply interface 16 is a plug or a socket configured for plug-in connection. As shown in FIG. 1, the first power supply interface 17 is a socket OUT, and the second power supply interface 16 is a socket IN.

Furthermore, the first power supply interface 17 and the second power supply interface 16 can be respectively and fixedly on the electric control board 1 or connected to the electric control board 1 through a connection wire. In FIG. 1, the first power supply interface 17 and the second power supply interface 16 are all sockets which are fixed on the electric control board 1.

Figure 2:
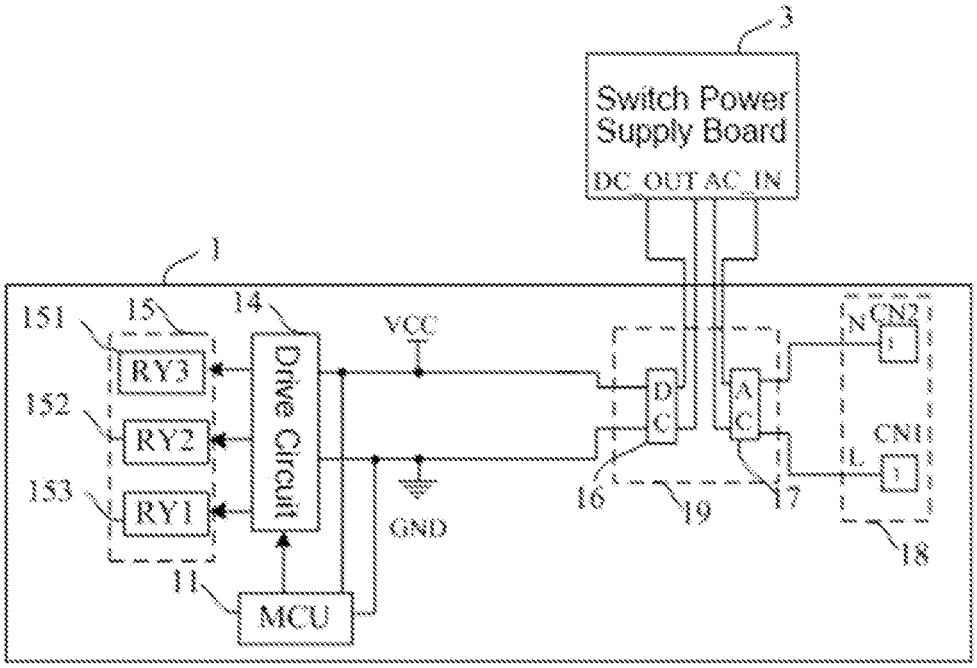
FIG. 2 is a schematic module diagram of the air conditioner electric control assembly in FIG. 1 including a switch power supply board.

As shown in FIG. 2, the air conditioner electric control assembly further includes a switch power supply board 3 which is discretely configured relative to the electric control board 1.

The switch power supply board 3 includes a direct-current power supply output interface DC_OUT connected to the second power supply interface 16, and a second alternating-current power supply input interface AC_IN connected to the first power supply interface 17. namely, the switch power supply board 3 is a power supply module connected to the first alternating-current power supply input interface 18 through the first power supply interface 17. The switch power supply board 3 inputs alternating current through the second alternating-current power supply input interface AC_IN, and the alternating current is converted by a switch power supply circuit on the switch power supply board 3 to obtain low-voltage direct current output from the direct-current power supply output interface DC_OUT to the second power supply interface 16.

Since the switch power supply board 3 directly outputs the low-voltage direct current to the electric control board 1 to provide a direct-current power supply for the operations of the drive circuit 14, the switch device 15 and the MCU 11, the rectifier circuit mounting site 12 and the filter circuit mounting site 13 do not need to be installed with devices. At this time, the rectifier circuit mounting site 12 is provided with two wires so as to short-connect the inputs and outputs of the rectifying circuit, so as to realize a direct connection of the low-voltage direct current from the second power supply interface 16 to the drive circuit 14, the MCU 11 and the switch device 15.

Since the switch power supply board 3 has a low standby power consumption, the switch power supply board 3 is connected to the electric control board 1 in a wire connection mode, so that the switch power supply board 3 can be directly connected to the electric control board when the low standby power consumption needs to be applied, and the electric control board does not need to be redesigned.

Figure 3:
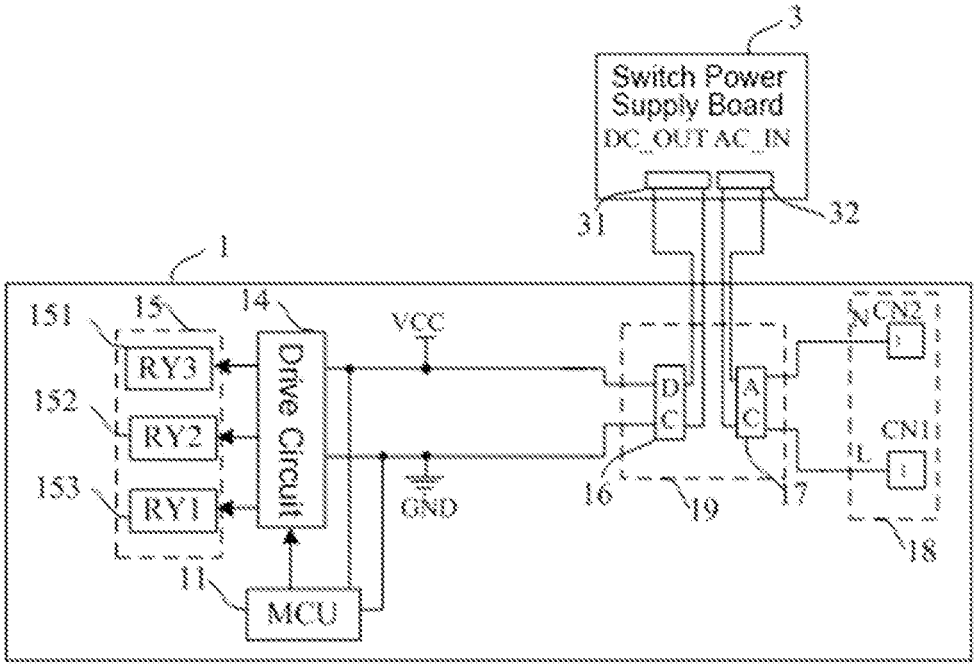
FIG. 3 is a schematic module diagram in which the switch power supply board interface in FIG. 2 is a socket.

Further, the direct-current power supply output interface DC_OUT is a plug or a socket configured for plug-in connection, and the alternating-current power supply input interface AC_IN is a plug or a socket configured for plug-in connection. Specifically, as shown in FIG. 3, the direct-current power supply output interface DC_OUT is a socket 31 configured on the switch power supply board 3. The alternating-current power supply input interface AC_IN is a socket 32 configured on the switch power supply board 3. Thus, the socket on the switch power supply board 3 and the socket on the electric control board 1 are connected through a connection wire with plugs at two ends. In this way, assembly on the production line can be facilitated.

Figure 4:
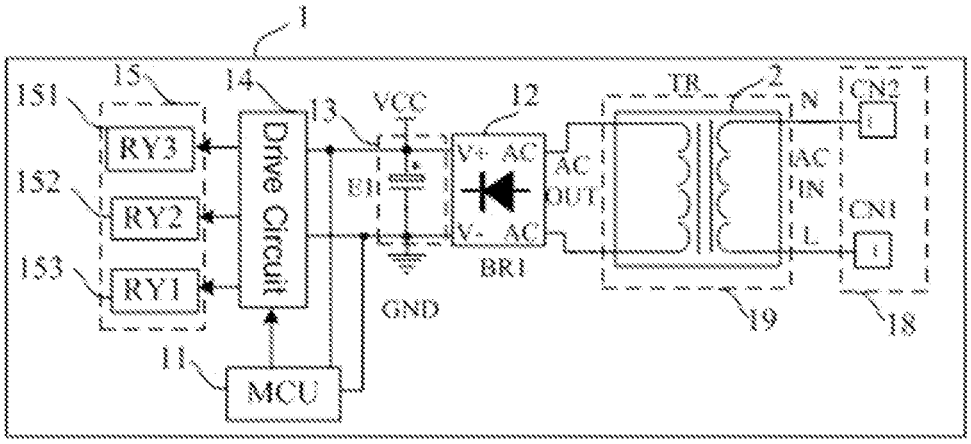
FIG. 4 is a schematic module diagram of the air conditioner electric control assembly in FIG. 1 including a linear transformer.

Further, the power supply module connected to the first power supply interface 17 and the first alternating-current power supply input interface 18 may be a linear transformer, as shown in FIG. 4, the air conditioner electric control assembly further includes a linear transformer 2. The linear transformer 2 includes a third alternating-current power supply input interface AC_IN connected to the first power supply interface 17, and a low-voltage alternating-current power output interface AC_OUT connected to the second power supply interface 16. The rectifier circuit mounting site 12 is provided with a rectifying circuit device to form a rectifying circuit, and the filter circuit mounting site 13 is provided with a wave- filtering device to form a filter circuit.

In this design, the rectifying circuit is specifically a rectifying bridge stack BR1. The filter circuit is specifically an electrolytic capacitor E1, The low-voltage alternating current output by the linear transformer 2 is rectified into a pulsating direct current through the rectifying bridge stack BR1, and a smooth direct current is output to the drive circuit 14, the MCU 11 and the switch device 15 through the filtering of the electrolytic capacitor E1. Due to the fact that the cost of the linear transformer 2 is relatively lower than the cost of the switch power supply 3, the linear transformer scheme can be adopted to replace the switch power supply board scheme in an application where low cost is needed and low standby power consumption is not required, so that the cost of the whole electric control scheme is reduced.

Moreover, the electric control board 1 is further provided with a mounting area 19 which can be used for installing the linear transformer 2, or the first power supply interface 17 and the second power supply interface 16. In FIG. 4, the linear transformer 2 is installed in a mounting area 19 presented as a dashed box, and the first power supply interface 17 and the second power supply interface 16 are not visible by the shielding of the linear transformer 2. When the linear transformer 2 is not installed, the first power supply interface 17 and the second power supply interface 16 can be sockets as shown in FIG. 3, and are connected to the switch power supply board 3 in a socket plug-in manner.

The first power supply interface 17 and the second power supply interface 16 are configured in the mounting area 19 which is a transformer mounting site, so that other positions of the electric control board 1 is not occupied by the first power supply interface 17 and the second power supply interface 16, and a PCB layout of the electric control board 1 can be facilitated, so that the electric control board 1 connecting to power supply modules of different power supply schemes with low-cost and simple design is realized.

The air conditioner electric control assembly of the present invention includes an MCU 11, a drive circuit 14, a switch device 15, a rectifier circuit mounting site 12, a filter circuit mounting site 13, a first power supply interface 17, a second power supply interface 16 and a first alternating-current power supply input interface 18, and is connected to a switch power supply board 3 or a linear transformer 2 through the second power supply interface 16 and the first alternating-current power supply input interface 18, so as to adopt power supply modules of different power supply schemes. Therefore, for different power supply schemes, the electric control board 1 can be generalized without redesign, which simplifies the design of the electric control board 1, reduces the cost, and facilitates the management of production of air conditioner electric control assemblies.

Figure 5:
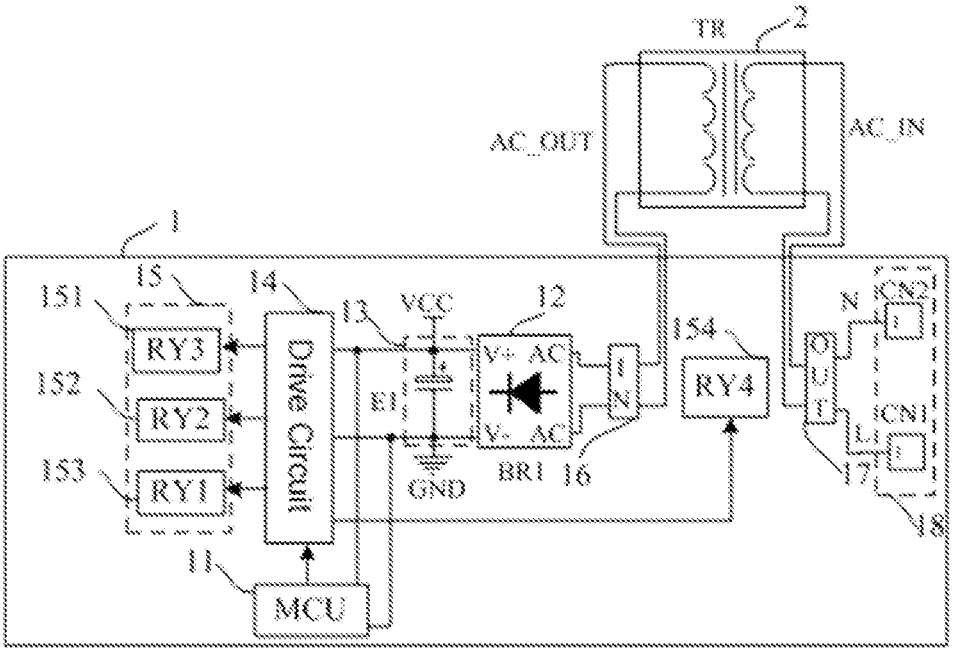
FIG. 5 is a schematic module diagram of a second embodiment of the air conditioner electric control assembly according to the present invention, which shows the linear transformer being discretely configured.

Further, as a second embodiment of the air conditioner electric control assembly of the invention, based on the first embodiment, as shown in FIG. 5, unlike the first embodiment, in the second embodiment the linear transformer 2 is separated from the electric control board 1.

In this design, the third alternating-current power supply input interface AC_IN is a plug or socket configured for plug-in connection, the low-voltage alternating-current power supply output interface AC_OUT is a plug or socket configured for plug-in connection, and the third alternating-current power supply input interface AC_IN and the low-voltage alternating-current power supply output interface AC_OUT are connected to the linear transformer through connection wires. Specifically, in FIG. 5, the third alternating-current power supply input interface AC_IN and the low-voltage alternating-current power supply output interface AC_OUT are plugs (not shown) connected to the connection wires. The second power supply interface 16 and the first power supply interface 17 are sockets, and the two plugs are respectively connected to the second power supply interface 16 and the first power supply interface 17 to realize electric connections. At this time, a distance between the two sockets of the second power supply interface 16 and the first power supply interface 17 is larger than a distance between the sockets of the second power supply interface 16 and the first power supply interface 17 when the second power supply interface 16 and the first power supply interface 17 are arranged in the installation area 19 in FIG. 3, so that other members can be configured between the two sockets, for example, as shown in FIG. 5, a relay RY4 for controlling the load is further configured between the two sockets to realize the full utilization of the PCB wiring area of the electric control board 1.

Figure 6:
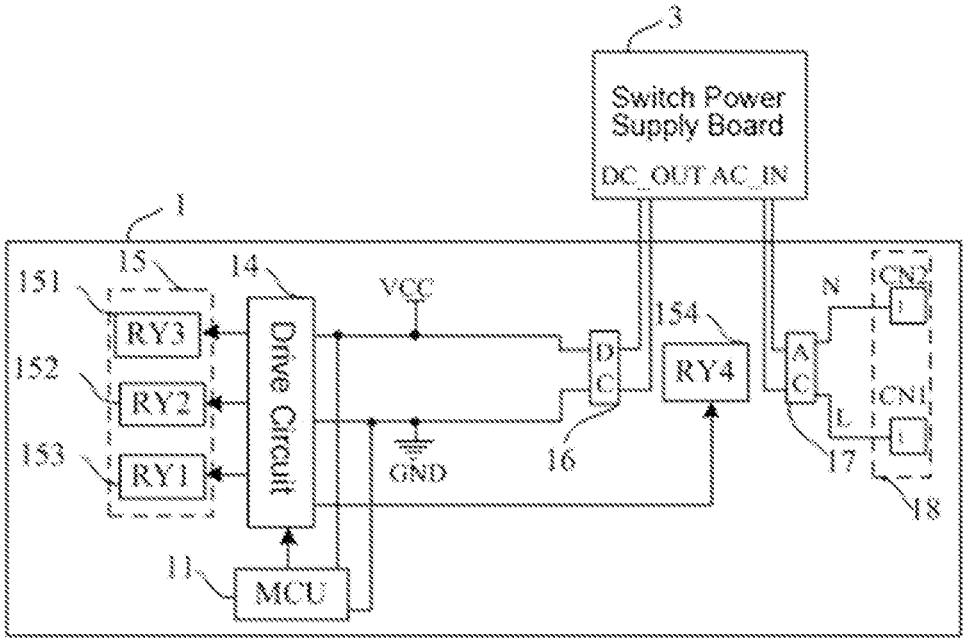
FIG. 6 is a schematic module diagram in which the linear transformer in FIG. 5 is replaced with a switch power supply board.

Since the electric control board 1 is connected to the discrete linear transformer 2 by a connection wire plugging mode, when the linear transformer 2 is replaced by the switch power supply scheme, the sockets of the second power supply interface 16 and the first power supply interface 17 can be directly used for being connected to the switch power supply board 3. As shown in FIG. 6, one end of each of the connection wires of the direct-current power supply output interface DC_OUT and the second alternating-current power supply input interface AC_IN of the switch power supply board 3 is provided with a plug which is connected to a socket on the electric control board 1 in a plug-in mode, and the filter circuit and the rectifying circuit adopt the same processing as the first embodiment.

Figure 7:
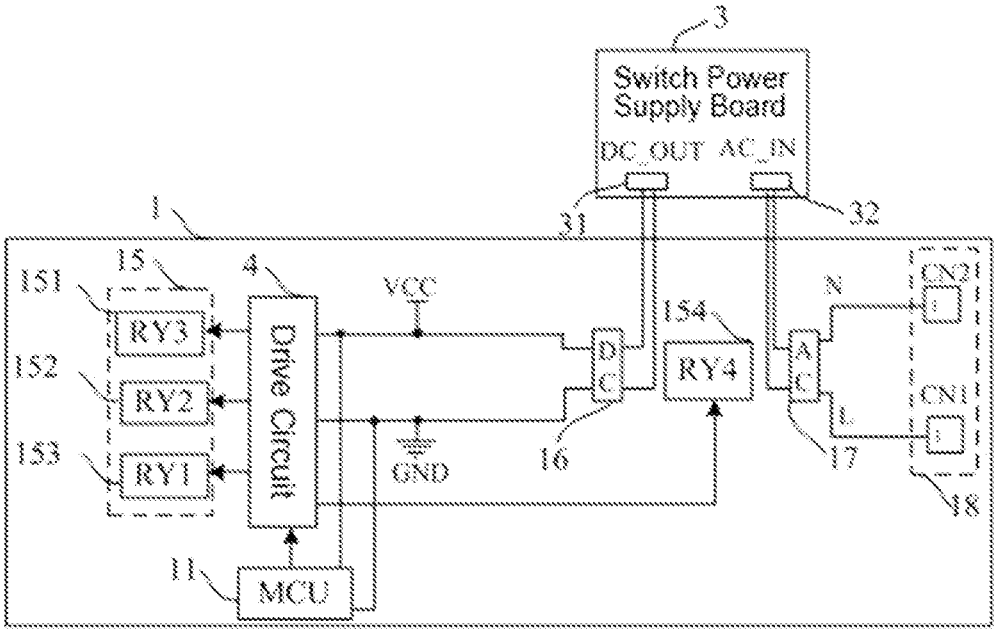
FIG. 7 is a schematic module diagram in which the switch power supply board interface in FIG. 6 is a socket.

Further, like the scheme of FIG. 3 in the first embodiment, a socket can also be configured on the switch power supply board 3, as shown in FIG. 7, the direct-current power supply output interface DC_OUT on the switch power supply board is a socket 31, the alternating-current power supply input interface AC_IN is a socket 32, and the socket on the switch power supply board 3 and the socket on the electric control board 1 are respectively connected through connection wires with plugs at two ends. Therefore, assembly on the production line can be facilitated.

The invention further provides an air conditioner including the electric control assembly described above.

In the description of the present invention, reference terms "first embodiment," "second embodiment," "example" and the like mean that a particular method, apparatus, or characteristic described in connection with the embodiment or example is included in at least one embodiment or example of the present invention. In this invention, a schematic representation of the above term is not necessarily intended to be the same embodiment or example. Furthermore, particular features, methods, apparatus, or characteristics described may be combined in any suitable manner in any one or more embodiments or examples. In addition, various embodiments or examples described in this specification, as well as features of different embodiments or examples, may be combined without conflict with each other.

The above are only exemplary embodiments of the present invention, which are not intended to limit the scope of the present invention. Any equivalent structure or equivalent process transformation made by using the description and the drawings of the present invention, or any direct or indirect application to other related technical fields are all included in the patent protection scope of the present invention.

The invention claimed is:

1. An air conditioner electric control assembly comprising:

an electric control board including:

a first alternating-current power supply input interface configured to receive an external alternating-current power supply;

a first power supply interface connected to the first alternating-current power supply input interface and configured to output a high-voltage alternating current;

a second power supply interface configured to connect a low-voltage alternating-current power supply or a low-voltage direct-current power supply;

a rectifier circuit mounting site connected to the second power supply interface;

a filter circuit mounting site connected to the rectifier circuit mounting site;

a drive circuit connected to the filter circuit mounting site;

a switch device connected to the drive circuit; and a microcontroller unit (MCU) connected to the drive circuit and configured to control the drive circuit to drive the switch device to switch state to drive a load to operate, and a linear transformer including a second alternating-current power supply input interface connected to the first power supply interface and a low-voltage alternating-current power supply output interface connected to the second power supply interface.

2. The electric control assembly of claim 1, wherein at least one of the first power supply interface or the second power supply interface includes a plug or a socket.

3. The electric control assembly of claim 2, wherein at least one of the first power supply interface or the second power supply interface is configured on the electric control board or connected to the electric control board through a connection wire.

4. The electric control assembly of claim 1, wherein at least one of the first power supply interface or the second power supply interface is configured on the electric control board or connected to the electric control board through a connection wire.

5. The electric control assembly of claim 1, further comprising:

a switch power supply board discretely configured relative to the electric control board;

wherein:

the switch power supply board includes a direct-current power supply output interface connected to the second power supply interface and a third alternating-current power supply input interface connected to the first power supply interface; and the electric control board further includes two conductive wires connected at the rectifier circuit mounting site to short connect inputs and outputs of a rectifying circuit mounted at the rectifier circuit mounting site.

6. The electric control assembly of claim 5, wherein at least one of the direct-current power supply output interface or the third alternating-current power supply input interface includes a plug or a socket.

7. The electric control assembly of claim 1, wherein:

the electric control board further includes:

a rectifying circuit device installed at the rectifier circuit mounting site to form a rectifying circuit; and a filter device installed at the filter circuit mounting site to form a filter circuit.

8. The electric control assembly of claim 1, wherein:

the electric control board further includes a mounting area; and the linear transformer is installed at the mounting area, or the second power supply interface and the first power supply interface are installed at the mounting area.

9. The electric control assembly of claim 1, wherein:

the linear transformer is discretely configured relative to the electric control board;

at least one of the second alternating-current power supply input interface or the low-voltage alternating-current power supply output interface includes a plug or a socket; and the second alternating-current power supply input interface and the low-voltage alternating-current power supply output interface are connected to the linear transformer through connection wires.

10. An air conditioner comprising:

an electric control assembly including:

an electric control board including:

a first alternating-current power supply input interface configured to receive an external alternating-current power supply;

a first power supply interface connected to the first alternating-current power supply input interface and configured to output a high-voltage alternating current;

a second power supply interface configured to connect a low-voltage alternating-current power supply or a low-voltage direct-current power supply;

a rectifier circuit mounting site connected to the second power supply interface;

a filter circuit mounting site connected to the rectifier circuit mounting site;

a drive circuit connected to the filter circuit mounting site;

a switch device connected to the drive circuit; and a microcontroller unit (MCU) connected to the drive circuit and configured to control the drive circuit to drive the switch device to switch state to drive a load to operate; and a linear transformer including a second alternating-current power supply input interface connected to the first power supply interface and a low-voltage alternating-current power supply output interface connected to the second power supply interface.

11. The air conditioner of claim 10, wherein at least one of the first power supply interface or the second power supply interface includes a plug or a socket.

12. The air conditioner of claim 11, wherein at least one of the first power supply interface or the second power supply interface is configured on the electric control board or connected to the electric control board through a connection wire.

13. The air conditioner of claim 10, wherein at least one of the first power supply interface or the second power supply interface is configured on the electric control board or connected to the electric control board through a connection wire.

14. The air conditioner of claim 10, wherein:

the electric control assembly further includes a switch power supply board discretely configured relative to the electric control board;

the switch power supply board includes a direct-current power supply output interface connected to the second power supply interface and a third alternating-current power supply input interface connected to the first power supply interface; and the electric control board further includes two conductive wires connected at the rectifier circuit mounting site to short connect inputs and outputs of a rectifying circuit mounted at the rectifier circuit mounting site.

15. The air conditioner of claim 14, wherein at least one of the direct-current power supply output interface or the third alternating-current power supply input interface includes a plug or a socket.

16. The air conditioner of claim 10, wherein:

the electric control board further includes:

a rectifying circuit device installed at the rectifier circuit mounting site to form a rectifying circuit; and a filter device installed at the filter circuit mounting site to form a filter circuit.

17. The air conditioner of claim 10, wherein:

the electric control board further includes a mounting area; and the linear transformer is installed at the mounting area, or the second power supply interface and the first power supply interface are installed at the mounting area.

18. The air conditioner of claim 10, wherein:

the linear transformer is discretely configured relative to the electric control board;

at least one of the second alternating-current power supply input interface or the low-voltage alternating-current power supply output interface includes a plug or a socket; and the second alternating-current power supply input interface and the low-voltage alternating-current power supply output interface are connected to the linear transformer through connection wires.

19. An air conditioner electric control assembly comprising:

an electric control board including:

a first alternating-current power supply input interface configured to receive an external alternating-current power supply;

a first power supply interface connected to the first alternating-current power supply input interface and configured to output a high-voltage alternating current;

a second power supply interface configured to connect a low-voltage alternating-current power supply or a low-voltage direct-current power supply;

a rectifier circuit mounting site connected to the second power supply interface;

a filter circuit mounting site connected to the rectifier circuit mounting site;

a drive circuit connected to the filter circuit mounting site;

a switch device connected to the drive circuit; and a microcontroller unit (MCU) connected to the drive circuit and configured to control the drive circuit to drive the switch device to switch state to drive a load to operate; and a switch power supply board discretely configured relative to the electric control board, the switch power supply board including a direct-current power supply output interface connected to the second power supply interface and a second alternating-current power supply input interface connected to the first power supply interface.

* * * * *